United States Patent [19]

Fligg

[11] Patent Number: 4,724,651

[45] Date of Patent: Feb. 16, 1988

[54] METHOD AND APPARATUS FOR INSTALLING INSULATION

[76] Inventor: Robert E. Fligg, 4913 Sylvan Rill Rd., Des Moines, Iowa 50321

[21] Appl. No.: 32,216

[22] Filed: Mar. 31, 1987

Related U.S. Application Data

[63] Continuation-in-part of Ser. No. 803,672, Dec. 2, 1985, abandoned.

[51] Int. Cl.[4] ..... E04B 1/62

[52] U.S. Cl. ..... 52/743; 52/407

[58] Field of Search ..... 52/743, 509, 407, 410, 52/309.1, 406

[56] References Cited

U.S. PATENT DOCUMENTS

| | | | |
|---|---|---|---|
| 4,075,807 | 2/1978 | Alderman | 52/407 |
| 4,134,242 | 1/1979 | Musz et al. | 52/309.1 |
| 4,233,791 | 11/1980 | Kuhl et al. | 52/309.1 |
| 4,434,601 | 6/1984 | Zellmer | 52/745 |

OTHER PUBLICATIONS

ABC publication, 8/1978, 2 pages.
Triple E publication, 5 pages.

*Primary Examiner*—John E. Murtagh
*Assistant Examiner*—Caroline D. Dennison
*Attorney, Agent, or Firm*—Henderson & Sturm

[57] ABSTRACT

A method of insulating the roof of a building by a strip of vinyl stretching a sheet of vinyl material between two structural beams of a building. A plurality of such sheets of vinyl backed fiberglass insulation are fastened side-by-side to each other to cover the area desired. Purlin clips are utilized to attach to purlin structural members extending across from one of the structural beams to the other and these are placed in a series of straight lines at predetermined intervals. These purlin clips have an aperture therein so that a band of metal can be threaded through each successive ones of the clips for the purpose of supporting the bottom side of the sheets of vinyl at even intervals along the length thereof. The adjacent edges of the vinyl sheets are positioned so that they will hang down and so that it can be separated by hand to permit loose insulation, such as chopped up fiberglass insulation to be blown between the vinyl sheets. After the entire area formed by the sheets of vinyl is filled, then the adjacent edges of the sheets of vinyl material are stapled together while in the such lower position thereof and then they are stuffed back up through the seam to a position above the vinyl sheets.

9 Claims, 10 Drawing Figures

METHOD AND APPARATUS FOR INSTALLING INSULATION

This application is a continuation-in-part application of co-pending application Ser. No. 06/803,672 filed Dec. 2, 1985 and entitled "Method and Apparatus for Installing Insulation" which is now abandoned.

TECHNICAL FIELD

The present invention relates generally to a method and apparatus for installing insulation into the top of a building, and more particularly to such a method which is fast, efficient, and dependable.

BACKGROUND ART

It is, of course, well known that buildings must be insulated in order to retain heat or cold when the temperatures outside are very different from the desired temperature within the building. This is particularly a problem in metal buildings of a commercial type, since metal is a very good conductor of heat.

In order to install insulation in the ceiling of a metal building, it has become a common practice to insulate during the initial construction of the building and to provide the insulation in the top of the building before the final layer of the roof is put onto the building, for example, as shown in U.S. Pat. No. 4,346,543 to Wilson et al. One of the problems with this approach is that the installation of the insulation interferes with the construction of the building. Usually, different people do the insulation work, and since the speed of installing the building is typically very important, the insulation steps detract from the timeliness of construction. Consequently, there is a need to be able to insulate a building more quickly.

Another category of insulation problems relates to insulating a building which is already existing, or adding insulation to such existing building in order to increase the R-factor of the ceiling or walls. Especially since each existing building is somewhat different, there is no one approach that seems to be universally acceptable.

Another major problem with metal buildings is that there is a great deal of expansion and contraction that occurs, especially from the extreme heat in summer to the extreme cold in winter. Prior art joints for insulation purposes tend to expand and thereby get damaged in the summer and contract and therefore open up in the winter to allow cold air to pass directly therethrough. Since the prior art structures do not completely solve this problem, there is a need for a method and apparatus for installing insulation which will adequately address the problem.

DISCLOSURE OF THE INVENTION

The present invention relates to a method of insulating the roof of a building by rolling one end of a strip of vinyl backed fiberglass insulation about a piece of wood or the like, and then utilizing a powder actuated fastener to attach such reinforced end of the vinyl backed fiberglass insulation to a structural beam of a building. The vinyl backed fiberglass insulation is then stretched across to another structural beam and that other end of the fiberglass vinyl backed fiberglass insulation is attached in the same manner by utilizing a reinforcing piece of wood or other material, and fastening it to the beam with a powder actuated fastener.

In one embodiment of this invention, a plurality of such strips of vinyl backed fiberglass insulation are initially fastened side-by-side to each other to cover the area desired. Purlin clips are utilized to attach to purlin structural members extending across from one of the structural beams to the other and these are placed in a series of straight lines at predetermined intervals wherein the purlin clips capture portions of the joined adjacent edges of the vinyl backed material.

These purlin clips have an aperture therein so that a band of metal can be threaded through each successive ones of the clips for the purpose of supporting the bottom side of the vinyl backed fiberglass material at even intervals along the length thereof. The previously joined adjacent edges of the vinyl backed fiberglass material are partially retracted from a position above the adjacent strips of vinyl backed fiberglass insulation so that a portion of the joined edges will hang down and so that they can be separated by hand to permit a tube to extend up through and between adjacent edges of the vinyl backed fiberglass insulation material. This permits loose insulation, such as chopped up fiberglass insulation, to be blown in above the vinyl backed strips of fiberglass insulation to increase the total depth of the insulation of the top part of the building. After the entire area formed by the strips of vinyl backed fiberglass insulation is filled, then the adjacent edges of the vinyl backed fiberglass insulation material are rejoined together such as by stapling, while in the such lower position thereof and then they are stuffed back up through the seam to a position above the vinyl backed fiberglass insulation and in the place where the loose insulation has been placed. This causes not only a very neat seam, but also provides a joint in the insulation which will withstand major contraction and expansion of the joint and still retain its structural integrity and its insulating properties. The purlin clips also have another opening therein for the purpose of hanging lights or other structures therefrom without the need to break through the fiberglass insulating barrier in order to get to a structural member from which to hang such fixtures.

The present invention relates to an improved method and apparatus for installing insulation into the top of a building.

Another object of the present invention is to provide a cost effective method of installing insulation in a dependable fashion.

A further object of the present invention is to provide a method and apparatus for installing insulation which produces an insulation structure which will accommodate major expansion and contraction of the building while retaining the structural integrity of the installation structure while retaining all of the needed insulating properties.

Other objects, advantages, and novel features of the present invention will become apparent from the following detailed description of the invention, when considered in conjunction with the accompanying drawings.

BEST MODE FOR CARRYING OUT THE INVENTION

Figure 1:
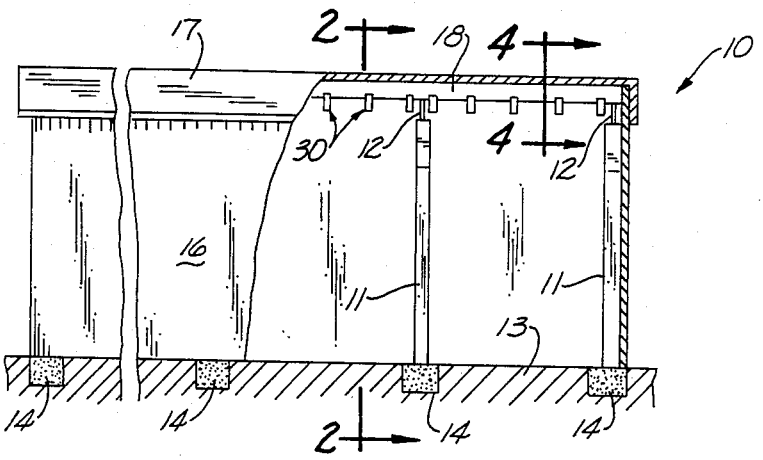
FIG. 1 shows a side elevational view of a building to be insulated by the present invention and showing a portion thereof broken away to show the structural interior of the building.
Figure 2:
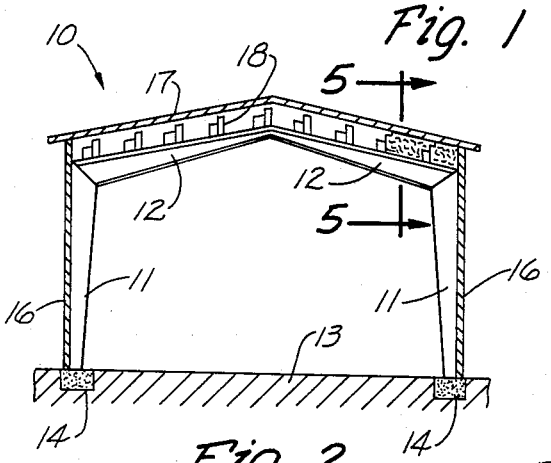
FIG. 2 is a cross sectional view taken along line 2—2 of FIG. 1.

Referring now to the drawings wherein like reference numerals designate identical or corresponding parts throughout the several views, FIG. 1 shows a building (10) which is to be illustrated as having the top portion thereof insulated by utilizing the method and apparatus of the present invention.

The building (10) has a plurality of vertical structural beams (11) and somewhat horizontally disposed beams (12) which attach together in the center of the building. The vertical beams (11) are secured to the earth (13) in concrete formations (14). The sidewalls of the building (16) are preferably formed of metal connected to the vertical beams (11) and the roof (17) is also preferably formed of metal which is supported by a plurality of purlin beams (18) extending across between adjacent ones of the somewhat horizontal structural beams (12).

Figure 5:
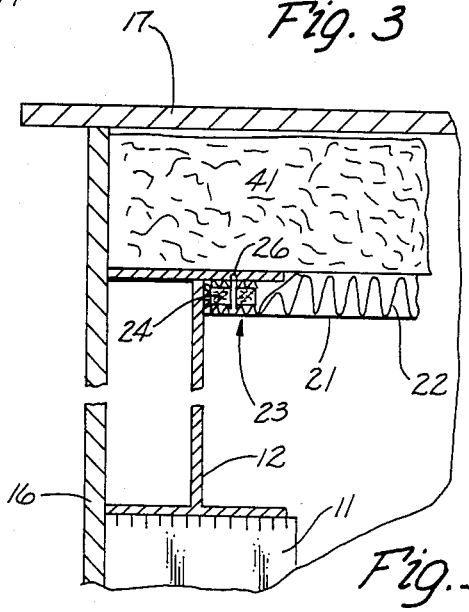
FIG. 5 is an enlarged partial cross sectional view taken along 5—5 of FIG. 2.

Referring to FIG. 5, it is noted that a sheet of vinyl material (21) having a batt of fiberglass (22) glued thereto has one end (23) of the vinyl (21) which has the fiberglass (22) removed therefrom so that it can be wrapped around a wooden slat (24) which is of approximately the same length of the fiberglass batting (22). Thihs constitutes a first step of the method of the present invention and after the slat (24) is positioned as shown in FIG. 5, then a powder actuated fastener is utilized to drive a rivet or pin (26) through the vinyl (21) and through the slat (24) to permanently be imbedded in a top portion of the beam (12) to permanently hold the one end (23) of the vinyl (21) in the position shown in FIG. 5. A plurality of such rivets or pins (26) are utilized along the length of the slat (24) to make sure that it will stay in position.

Figure 6:
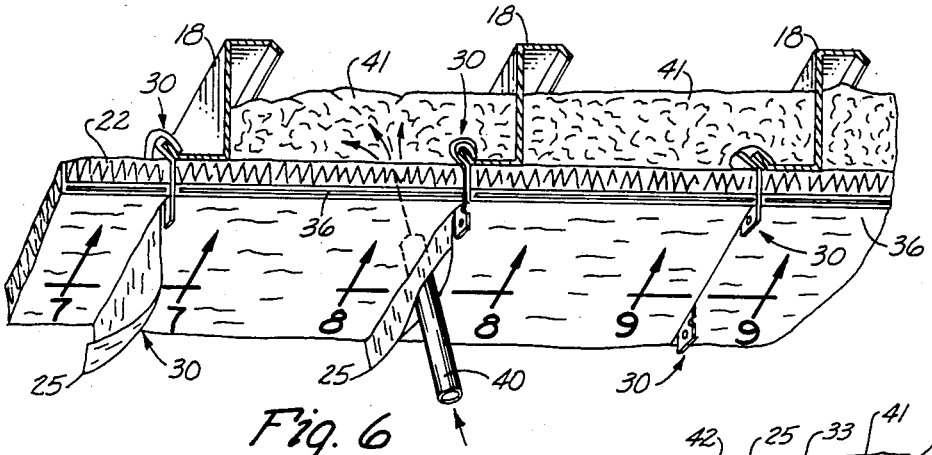
FIG. 6 is a perspective view of the method of the present invention shown during the process of forming the insulation structure of the present invention.

After that has been done, then the vinyl (21) with the fiberglass strip (22) attached thereto is stretched across to the next adjacent beam (12) and the other end of the vinyl (21) is attached to the other beam (12) in the exact same fashion that the end (23) was just described as being attached to the beam (12) in FIG. 5. It will be noted by viewing FIG. 6 on the left side thereof that edges (25) of the vinyl (21) do not have fiberglass batting (22) attached thereto, and consequently are in a position to hang downwardly as shown in FIG. 6 during this process of stretching the vinyl (21) across from one beam (12) to the other and fastening it in place. This process of stretching successive strips or sheets of vinyl (21) across from one beam to the other adjacent to the last one just installed is shown for example in FIG. 6. At which point the adjacent side-by-side edges (25) may be joined together, as by stapling or the like.

Figure 3:
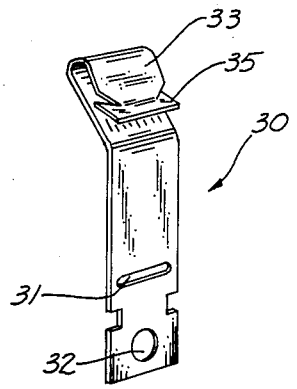
FIG. 3 is a perspective view of a purlin clip constructed in accordance with the present invention.
Figure 4:
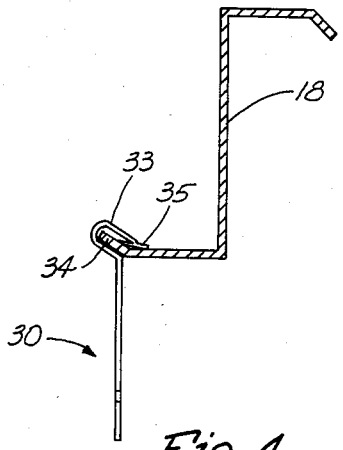
FIG. 4 is an enlarged partial cross sectional view taken along line 4—4 of FIG. 1 and showing a purlin clip connected to a purlin structural member.

The next step of the process is then to attach a plurality of the purlin clips (30) that are shown in FIGS. 3 and 4 to the purlins (18) for example as shown in FIG. 4. It will be understood that various shapes of purlins (18) can be used and various shapes of purlin clips (30) are also possible as long as they have an aperture (31) therein for receiving a metal strip which will be described below. Another opening (32) is formed in the bottom of the purlin clip (30) for hanging light fixtures or any other fixture therefrom as will be described below. The top flange (33) of the purlin clip extends over an edge (34) of the bottom of the purlin to hold it in place and another flange (35) on the purlin clip (30) is in frictional contact with the member (34) in order to keep the purlin clip (30) from slipping off the purlin (18). Other configurations for flanges (33 and 35) will be apparent to those skilled in the art, while still functioning in substantially the same manner.

Figure 8:
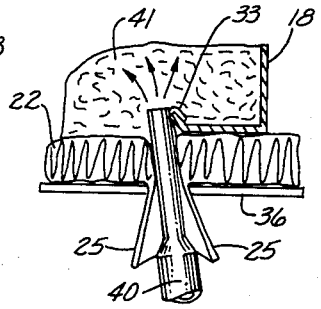
FIG. 8 is an enlarged partial cross sectional view taken along line 8—8 of FIG. 6.
Figure 9:
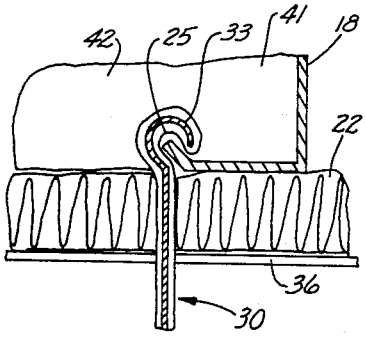
FIG. 9 is an enlarged partial cross sectional view taken along line 9—9 of FIG. 6 showing the joint in its completed condition.
Figure 10:
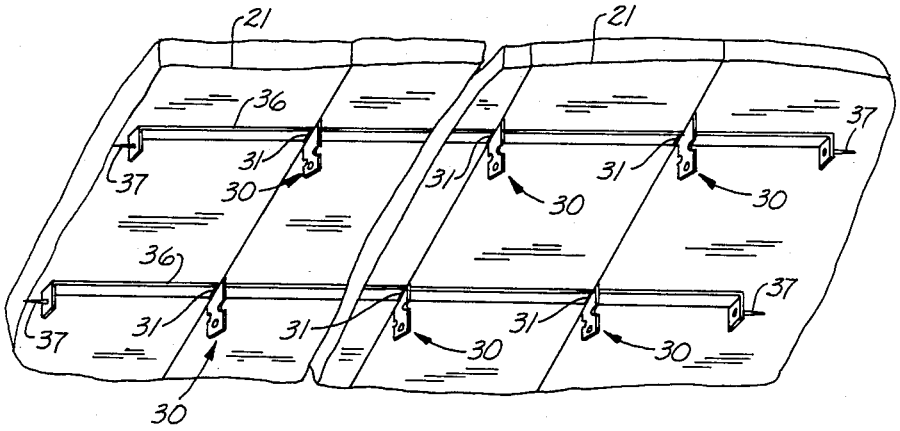
FIG. 10 is a perspective view looking up at a completed section of the underside of the roof which was formed by utilizing the method and apparatus of the present invention.

A plurality of the purlin clips (30), for example as shown in FIGS. 6 and 10, are hung on to the purlin members (18) in a straight line with each other and a number of evenly spaced purlin clips (30) are so placed all the way along the purlins (18), for example as shown in FIG. 10. Once the purlin clips are in alignment in rows, for example as shown in FIGS. 6 and 10, a strip of metal banding (36) is threaded through each one of the openings (31) and attached by fasteners (37) to the building at the ends thereof. This provides a good sound support for the strips of sheets of vinyl (21) which are also securely attached at the ends thereof by the structure (23) shown in FIG. 5. After a portion of the seams have been tucked above the insulation by insertion of the purlin clips which capture the joined edges adjacent the purlin clips (30) as shown in FIG. 9, then the process of installing the insulation is complete. If it is desired after that to hang lights, heaters, or other fixtures from the top of the building, wires passing through the openings (32) in the purlin clips (30) can suspend such fixtures from the ceiling. This can be done immediately, or at any other later time without destroying the structural integrity of the insulation structure just formed by this process. This is in contrast to other insulation processes which may require that a seam be broken somewhere in order to get up to one of the structural purlins (18) for attachment to hang some fixture therefrom. After these clips (30) have been so placed, then a tube (40) as shown in FIGS. 6 and 8 is utilized to blow loose insulation (41), such as chopped up fiberglass, for example, to the position between the purlins (18) and above each one of the vinyl backed fiberglass strips (21 and 22). It will readily be appreciated that at this point in time, selective removal of some of the staples is required so that nothing is holding the flaps (25) from being separated apart by putting the tube (40) between them.

Figure 7:
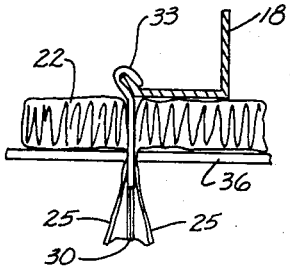
FIG. 7 is an enlarged partial cross sectional view taken along 7—7 of FIG. 6.

After all of the space between adjacent purlins (18) has been filled, for example as shown in the rightmost section of FIG. 6, then the adjacent edges (25) of the vinyl strips or sheets (21) where the staples have been removed are folded over and restapled together while they are in the position shown in FIG. 7; and, then this joint formed by the staple (42) is tucked up into the position shown in FIG. 9 and also as shown in the rightmost seam of FIG. 6 and in FIG. 10. The seam shown in FIG. 9 is tight and well insulated to prevent air from passing therethrough, but at the same time, if the joint were to expand, it will be appreciated that the joint will keep its structural integrity and still remain well insulated. Similarly, if there is some contraction of the joint shown in FIG. 9, it will not be destroyed by such contraction, but the insulation will merely temporarily become compacted with plenty of insulating properties present above and to each side of the joint.

It should also be appreciated that an alternate method could be employed by initially joining the stapling or the like, major portions of the adjacent edges (25) of the vinyl (21) such that spaced segments of the adjacent edges (25) remain unstapled and hanging loosely below the insulation strips as shown in FIG. 8, until such time as the tube (40) has been inserted and withdrawn from a position above the insulation strips. At this point, the unjoined edges may be secured together and tucked above the insulation as shown in FIG. 9.

Obviously, many modifications and variations of the present invention are possible in light of the above teachings. For example, the strips of sheets of vinyl (21) could be constructed of some other material and also they would not necessarily need to have the fiberglass (22) attached to the top thereof since the entire space above the sheets or strips (21) could be filled with loose fiberglass (41) or some other loose insulating material. Similarly, the joint (21) shown in FIG. 5 could be attached in many other ways than in the manner shown. It is therefore to be understood that, within the scope of the appended claims, the invention may be practised otherwise than as specifically described.

I claim:

1. A method of insulating under a pre-existing roof of a building of a type having a pair of spaced apart structural beams extending in one direction supported in the building under the roof thereof and a plurality of spaced apart elongated purlins extending transversely to said structural beams and being supported by said structural beams and utilizing purlin clips of a type having means on the top thereof for connection to a purlin and aperture means on a lower portion thereof for receiving a strip of metal; said method comprising:

(a) attaching one end of a strip of backed fiberglass insulation approximately as wide as the distance between purlins along one end thereof to one of said structural beams;

(b) attaching the other end of said strip of backed fiberglass insulation to the other one of said structural beams;

(c) repeating steps (a) and (b) with a second strip of backed fiberglass insulation approximately the same size as the first said strip, wherein one side of the first said strip is adjacent to one side of said second strip, each of said strips having an edge of said strip hanging down in juxtaposition with respect to each other;

(d) repeating the steps of (a) and (b) using a third strip of backed fiberglass insulation approximately the size of first said strip, adjacent to said second strip wherein the other side of said second strip and one side of the third strip have an edge thereof hanging down in juxtaposition with respect to each other;

(e) attaching one of said purlin clips to each of said purlins which are disposed directly above the first said, second and third strips of backed fiberglass insulation wherein said purlin clips are in a straight line;

(f) threading a continuous one piece elongated band through the aperture means in each of said aligned purlin clips wherein said band will support the underside of the first said, second and third strips;

(g) extending a tube between the first and second strips;

(h) blowing loose insulation through said tube to position the loose insulation above said second strip;

(i) extending said tube between said second and third strips;

(j) blowing loose insulation through said tube to position the loose insulation above said third strip;

(k) fastening adjacent edges of the first and second strips together and tucking them up above the first and second strips to form an expansion joint; and (l) fastening adjacent edges of the second and third strips together and tucking them up above the second and third strips to form an expansion joint.

2. The method of claim 1 wherein in steps (k) and (l) staples are used to connect the edges of the first and second strips together.

3. The method of claim 1 wherein in steps (h) and (j) the loose insulation includes fiberglass material.

4. The method of claim 1 wherein in step (f) the elongated band is constructed of metal.

5. The method of claim 1 including attaching another set of said purlin clips, one each to each of said purlins of step (e) at a predetermined spaced distance from the purlins of step (e) and threading a second elongated band through the aperture means in each of said another set of aligned purlin clips for supporting another part of the underside of said strips.

6. The method of claim 1 wherein steps (a) through (l) are done sequentially in alphabetical order.

7. The method of claim 1 including the steps of connecting the ends of the elongated band to the sides of the building.

8. The method of claim 1 wherein said fiberglass insulation is backed with material.

9. A method of insulating the roof of a building of a type having a pair of spaced apart structural beams extending in one direction supported in a building and a plurality of spaced apart elongated purlins extending transversely to said structural beams and being supported by said structural beams and utilizing purlin clips of a type having means on the top thereof for connection to a purlin and aperture means on a lower portion thereof for receiving a strip of metal; said method comprising:

(a) attaching one end of a sheet of material approximately as wide as the distance between purlins along one end thereof to one of said structural beams;

(b) attaching the other end of said sheet of material to the other one of said structural beams;

(c) repeating steps (a) and (b) with a second sheet of material approximately the same size as the first said sheet, wherein one side of the first said sheet is adjacent to one side of said second sheet, each of said sheets having an edge of said sheet hanging down in juxtaposition with respect to each other;

(d) repeating the steps of (a) and (b) using a third sheet of material approximately the size of first said strip, adjacent to said second sheet wherein the other side of said second sheet and one side of the third sheet have an edge thereof hanging down in juxtaposition with respect to each other;

(e) attaching one of said purlin clips to each of said purlins which are disposed directly above the first said, second and third sheets wherein said purlin clips are in a straight line;

(f) threading an elongated band through the aperture means in each of said aligned purlin clips wherein said band will support the underside of the first said, second and third sheets;

(g) extending a tube between the first and second sheets;

(h) blowing loose insulation through said tube to position the loose insulation above said second sheet;

(i) extending said tube between said second and third sheets;

(j) blowing loose insulation through said tube to position the loose insulation above said third sheet;

(k) fastening the adjacent edges of the first and second sheets together and tucking them up above the first and second sheets to form an expansion joint; and (l) fastening the adjacent edges of the second and third sheets together and tucking them up above the second and third sheets to form an expansion joint.

* * * * *